US007393054B2

(12) United States Patent
McQueen et al.

(10) Patent No.: US 7,393,054 B2
(45) Date of Patent: Jul. 1, 2008

(54) SELF ADJUSTING SEATBACK SYSTEM

(75) Inventors: Kenneth McQueen, Leonard, MI (US); Peter A. Bacarella, Chesterfield Township, MI (US); Jim Wawrzyniak, Warren, MI (US)

(73) Assignee: Lear Corporation, Southfield, MI (US)

( * ) Notice: Subject to any disclaimer, the term of this patent is extended or adjusted under 35 U.S.C. 154(b) by 205 days.

(21) Appl. No.: 11/164,296

(22) Filed: Nov. 17, 2005

(65) Prior Publication Data

US 2007/0108816 A1 May 17, 2007

(51) Int. Cl.
*A47C 3/00* (2006.01)

(52) U.S. Cl. ..... 297/284.4

(58) Field of Classification Search ..... 297/284.7, 297/284.4, 284.1, 217.3
See application file for complete search history.

(56) References Cited

U.S. PATENT DOCUMENTS

| | | | | | |
|---|---|---|---|---|---|
| 272,579 | A | * | 2/1883 | Paulding | 297/291 |
| 1,789,821 | A | * | 1/1931 | Leffingwell | 297/284.7 |
| 2,831,533 | A | * | 4/1958 | Pasquarelli | 297/284.5 |
| 2,843,195 | A | * | 7/1958 | Barvaeus | 297/284.4 |
| 2,991,124 | A | * | 7/1961 | Schwarz | 297/284.4 |
| 3,121,592 | A | * | 2/1964 | Anderson | 297/284.1 |
| 4,469,374 | A | | 9/1984 | Kashihara et al. | |
| 4,556,251 | A | | 12/1985 | Takagi | |
| 4,623,193 | A | | 11/1986 | Lieker | |
| 4,711,493 | A | | 12/1987 | Schrom et al. | |
| 4,832,401 | A | | 5/1989 | Brooks | |
| 4,880,271 | A | | 11/1989 | Graves | |
| 5,110,121 | A | | 5/1992 | Foster | |
| 5,113,176 | A | | 5/1992 | Harris | |
| 5,244,252 | A | | 9/1993 | Serber | |
| 5,425,566 | A | * | 6/1995 | Buchacz | 297/301.2 |
| 5,505,520 | A | | 4/1996 | Frusti et al. | |
| 5,730,688 | A | | 3/1998 | Prusick | |
| 5,735,574 | A | * | 4/1998 | Serber | 297/284.4 |
| 5,772,281 | A | | 6/1998 | Massara | |
| 6,309,018 | B1 | | 10/2001 | Jernstrom | |
| 6,312,366 | B1 | | 11/2001 | Prusick | |
| 6,499,803 | B2 | | 12/2002 | Nakane et al. | |
| 6,644,740 | B2 | | 11/2003 | Holst et al. | |
| 6,719,368 | B1 | | 4/2004 | Neale | |
| 6,749,261 | B2 | * | 6/2004 | Knoblock et al. | 297/284.4 |
| 6,837,541 | B2 | | 1/2005 | Farquhar et al. | |
| 6,938,956 | B1 | * | 9/2005 | Piretti | 297/284.7 |
| 7,000,987 | B2 | * | 2/2006 | Staarink | 297/284.7 |
| 2001/0043002 | A1 | | 11/2001 | Nakane et al. | |
| 2002/0008417 | A1 | | 1/2002 | Holst et al. | |
| 2003/0012240 | A1 | | 1/2003 | Yamamoto et al. | |
| 2003/0057757 | A1 | | 3/2003 | Martin | |
| 2003/0197393 | A1 | | 10/2003 | Hanagan | |
| 2004/0061362 | A1 | | 4/2004 | Farquhar et al. | |
| 2004/0075312 | A1 | | 4/2004 | Neale | |
| 2005/0046252 | A1 | | 3/2005 | McMillen | |
| 2005/0147515 | A1 | | 7/2005 | Cusak | |
| 2005/0161980 | A1 | | 7/2005 | Rashidy et al. | |

* cited by examiner

*Primary Examiner*—Milton Nelson, Jr.
(74) *Attorney, Agent, or Firm*—Brooks Kushman P.C.

(57) ABSTRACT

A seatback system having self-adjusting lumbar support. The seatback system including a pivot configured for facilitating rotating of a lumbar support in response to pressure applied thereto by a seat occupant.

20 Claims, 2 Drawing Sheets

SELF ADJUSTING SEATBACK SYSTEM

BACKGROUND OF THE INVENTION

1. Field of the Invention

The present invention relates to seating systems having seatbacks for supporting occupants of the type wherein a lumbar support is included to support a lumbar portion of the occupant.

2. Background Art

Seating systems are commonly used in any number of environments and vehicles to support occupants in a seating position. Some seating system include a feature in the seatback to support a lumbar portion of the seat occupant, commonly referred to as a lumbar support.

The lumbar support is generally configured to be provide a bulge or other rigid or semi-rigid feature in the seatback for focusing support on the lumbar portion of the occupant. In some cases, a positioning of the lumbar support within the seatback may be controlled by the occupant.

Such lumbar seatback assemblies are uniform to all seat occupants, regardless of the size and other parameters of the occupant. This can make it difficult in maximizing the position of the lumbar support relative to the occupant.

SUMMARY OF THE INVENTION

One non-limiting aspect of the present invention relates to a seatback system that improves alignment of a lumbar support relative to a seat occupant.

One non-limiting aspect of the present invention relates to a self-adjusting lumbar support to improve alignment of the lumbar support relative to the seat occupant, such as to permit an apex of the lumbar support to mold or confirm to spinal contours of the seat occupant.

One non-limiting aspect of the present invention relates to a seatback system having self-adjusting lumbar support. The system may include a lumbar support configured to support a lumbar portion of a seat occupant and a pivot configured to permit the lumbar support to pivot with pressure applied by the occupant such that the lumbar support self-adjusts to the occupant.

The system may include a lumbar frame connected to the lumbar support and the pivot such that pressure applied by the occupant causes the frame to rotate the lumbar support about the pivot.

The system may include an actuator to move the lumbar support along the lumbar frame. Optionally, the lumbar frame may be elongated such the actuator moves the lumbar support along a longitudinal axis of the lumbar frame.

The actuator may pivot with rotation of the lumbar frame.

The system may include a seatback frame, wherein the pivot is connected to the seatback frame such that the actuator, lumbar frame, and lumbar support each simultaneously rotate about the pivot while the seatback frame remains fixed when the pressure is applied by the occupant.

The actuator may move the lumbar support in an up/down manner along the lumbar frame and/or to flex the lumbar support in/out with the up/down movement.

Optionally, an end of the frame extends outboard of the lumbar support to facilitate rotation of the lumbar support relative to the pivot when the pressure is applied by the occupant.

The pivot may be connected to a center of the lumbar frame.

The lumbar support may be connected to the lumbar frame and the lumbar frame may be connected to the pivot.

The pivot may be free-floating.

One non-limiting aspect of the present invention relates to a seatback system having self-adjusting lumbar. The system may include a lumbar frame having at least two rails, a lumbar support configured to slide along the two rails of the lumbar frame, and a pivot connected to the lumbar frame to permit the lumbar support to pivot with pressure applied by the occupant such that the lumbar support self-adjusts to the occupant.

The system may include an actuator configured to cause in/out movement of the lumbar support, optionally, causing at least one end of the lumbar support to slide along the two rails such that the lumbar flexes in an in/out manner.

The actuator may be connected to the lumbar frame such that the actuator rotates with the lumbar support and frame when pressure is applied by the occupant.

One non-limiting aspect of the present invention relates to a method of controlling a lumbar support. The method may include receiving signals for adjusting a positioning of the lumbar support, controlling an electrically driven actuator to position the lumbar support as a function of the received signals, and rotating of the lumbar support about a pivot after the lumbar support is adjusted and as a function of pressure applied thereto by an occupant.

The method may include controlling another electrically driven actuator to rotate a pivot connected to the lumbar support.

The method may include rotating the lumbar support as a function of signals received from pressure sensors attached to outboard ends of a lumbar frame connected to the lumbar support, the outboard ends extending outboard of the lumber support.

The above features and advantages, along with other features and advantages of the present invention, are readily apparent from the following detailed description of the invention when taken in connection with the accompanying drawings.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
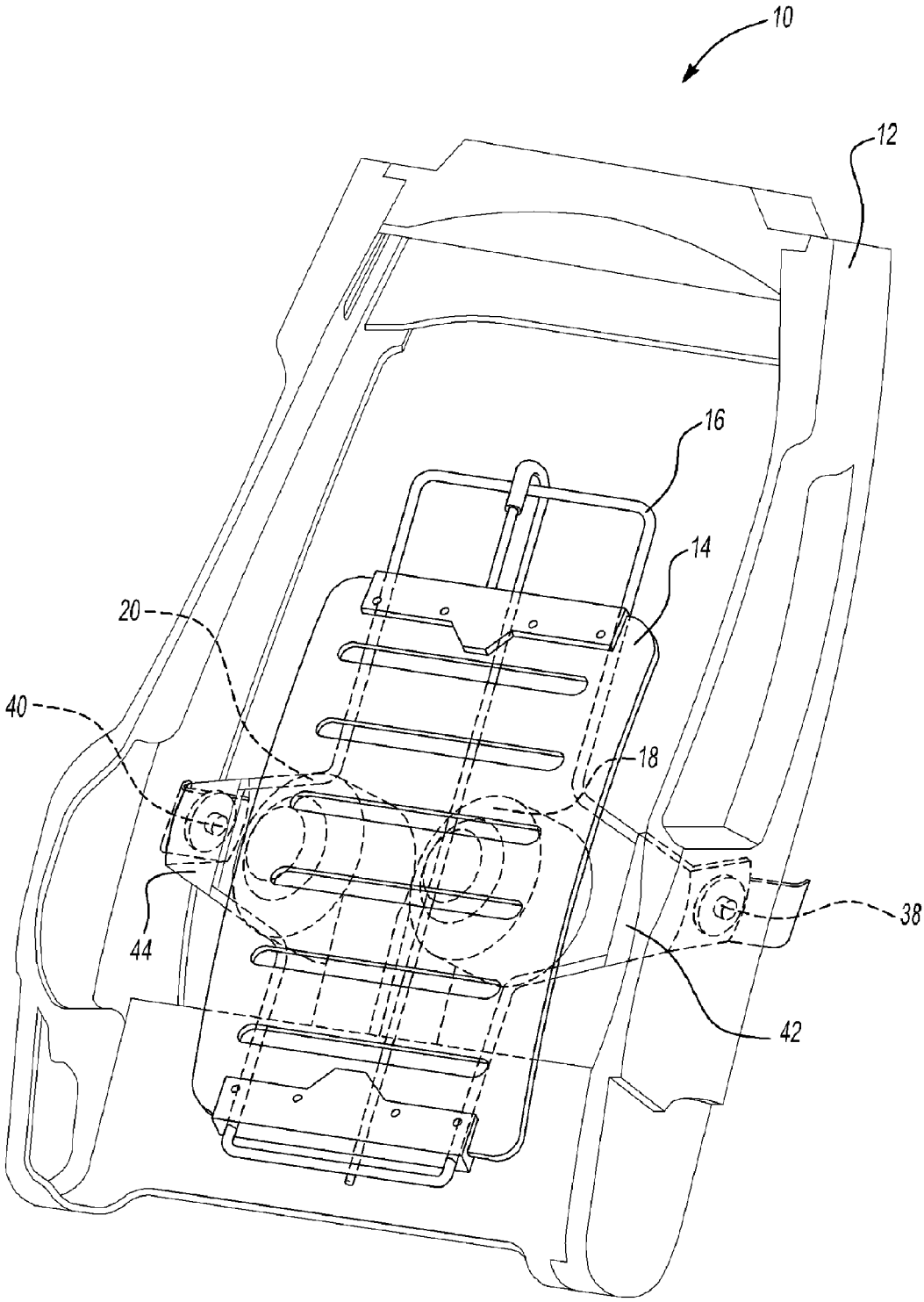
FIGS. 1-2 illustrate a seatback system in accordance with one non-limiting aspect of the present invention.
Figure 2:
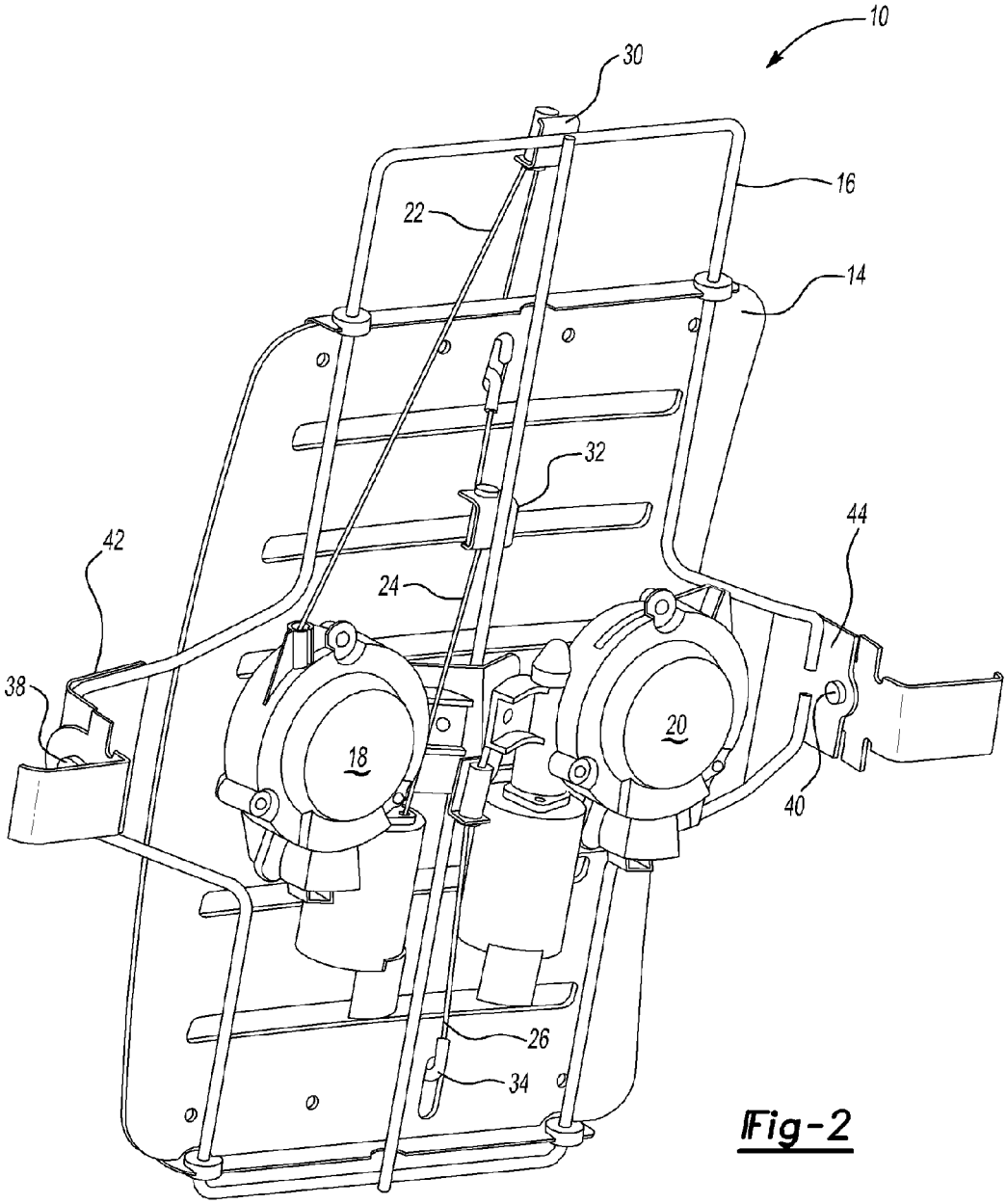

FIGS. 1-2 illustrate a seatback system 10 in accordance with one non-limiting aspect of the present invention. The seatback system 10 may be used in any number of environments to support any number of occupants. In particular, the seatback system 10 may be used in automobiles, buses, planes, watercraft, and any number of other vehicles. Likewise, the seatback system 10 may be used in commercial, residential, and other non-vehicle seating systems and arrangements. Accordingly, the present invention is not intended to be limited to any particular application or environment.

The system 10 may include a seatback frame 12 for providing a general contour and structure of a seatback (not shown). Padding, upholstery, and other features may be attached or otherwise connected to the seatback frame 12 to facilitate supporting and comforting a seat occupant, as one having ordinary skill in the art will appreciate.

The system 10 may include a lumbar support 14 to support a lumbar portion of the seat occupant. The lumbar support 14 may be generally elongated and comprise a rigid or semi-rigid material having properties for supporting the lumbar portion of the seat occupant. The lumbar support 14 is configured to flex in/out to support the seat occupant. Any number of suitable plastics and metals, or combinations thereof, having sufficient flexibility may be used. Optionally, openings or other apertures may be include to facilitate the flexing thereof.

The lumbar support 14 may be connected to or otherwise attached to a lumbar frame 16. The lumbar frame 16 may include a pair of rails to which the lumbar support 14 may connect. The frame 16 may permit vertical (up/down) motion of the lumbar support 14, such as to permit the lumbar support to be positioned relative to the lumbar portion of the occupant. One or more actuators 18-20 may be attached to the lumbar frame to control movement of the lumbar support within the frame.

The actuators 18-20 may be mechanically and/or electrically driven. A mechanical or electrical device (not shown) may be included on the lumbar frame 14 or in other communication with the actuator to control the operation thereof. Optionally, the device (not show) may be a switch or lever connected to the seatback frame 12 or to another feature in the vicinity of the system 10 to facilitate controlling the actuators 18-20. A control module (not shown) or other feature may be configured to receive signals from the switch for electrically actuating the actuators 18-20, and thereby, control positioning of the lumbar support and/or the seatback frame.

The actuator may be connect to the lumbar support through cables 22-26 or other features. Axial ends of the lumbar support 14 may include hooking features 30-34 to connect the lumbar support 14 to the cables 22-26 to permit the movement thereof. In more detail, the actuators 18-20 may be rotary actuators configured to wind and unwind the cables 22-26 so as to move the lumbar support in an up/down manner, such as to provide two-way movement of the lumbar support.

Optionally, the actuators 18-20 may be configured to permit one end of the lumbar support 14 to move while the other end remains fixed such that the lumbar support 14 is caused to flex in/out. The flexing of the lumbar support 14 in this manner may be used to control bulging or bowing of the lumbar support 14, and thereby, the amount of lumbar support provided against the lumbar portion of the seat occupant.

Pivots 38-40 may be connected to the lumbar frame 14 by way of brackets 42-44 and/or other features. The pivots 38-40 may then be used to permit rotation of the lumbar frame 16, and all features connected thereto, about the seatback frame 12. The pivots 38-40 may be a free-floating feature configured to rotate in response to pressure applied to the lumbar support 14 by the seat occupant. The pivots 38-40 may include bearings or other features (not shown) to facilitate the rotation thereof.

The connecting of the lumbar support 14 to the lumbar frame 16 and the lumber frame 16 to the pivots 38-40 cause both of the lumbar support 14 and frame 16 to rotate with the applied pressure. Likewise, the actuators 18-20 connected to the lumbar frame 16 are similarly rotated to cause all lumbar features to rotate with the applied pressure.

The rotation of the lumbar support 14 and attendant features may be advantageous in improving alignment of the lumbar support 14 relative to the seat occupant. In particular, the rotating lumbar support 14 may provide a self-adjusting lumbar feature to improve alignment of the lumbar support relative to the seat occupant, such as to permit an apex of the lumbar support to mold or confirm to spinal contours of the seat occupant.

The pivots 38-40, as shown, connect to the lumbar frame 16, which in turn connects to the lumbar support 14 and actuators 18-20. The present invention, however, is not so limited and fully contemplates any number of variations to this arrangement. The pivots 38-40 are intended to rotate the lumbar support 14 and features attendant to the operation thereof so that the lumbar support 14 self-adjusts to the seat occupant. Accordingly, the pivots 38-40 may be connected to anyone of the features associated with the lumbar support 14, and/or the lumbar support 14 itself, as long as the lumbar support 14 is able to self-adjust to the seat occupant.

Figure 3:
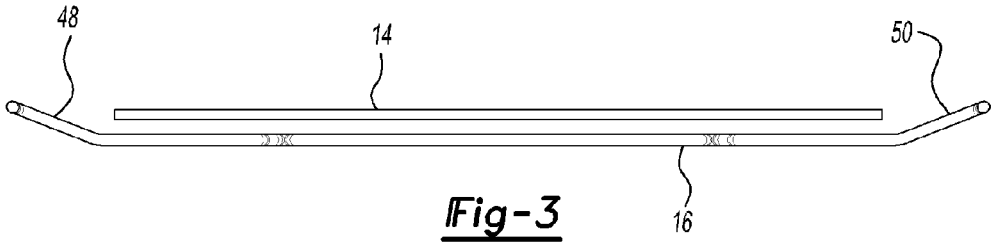
FIG. 3 illustrates a lumbar frame in accordance with one non-limiting aspect of the present invention.

FIG. 3 illustrates the lumbar frame 16 in accordance with one non-limiting aspect of the present invention. The lumbar frame 16 may include angled, outboard features 48-50 at the axial ends thereof. The outboard features 48-50 may extend out board of the lumbar support 14 towards the seat occupant such that pressure may be applied thereto by the seat occupant. The outboard portions 48-50 may be used to facilitate rotation of the lumbar support 14 as the outboard portions 48-50 tend to enhance rotation of the lumbar support 14 so that less pressure is required by the seat occupant to self-adjust the positioning thereof.

Optionally, a pivot actuator (not shown) may be used in place of the free-floating pivots 38-40 to provide controlled motion of the lumbar support 14 and attendant features. The pivot actuator may be electronically controlled by the seat occupant and/or with signals generated from the control module. Optionally, sensors may be positioned at the ends of the lumbar frame 16 to sense pressure and permit the self-adjustment of the lumbar support 14. The pressure signals may then be used by the control module to control pivoting of the pivot lumbar, and thereby, positioning of the lumbar support.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

What is claimed is:

1. A seatback system having self-adjusting lumbar support, the system comprising:

a lumbar support configured to support a lumbar portion of a seat occupant;

a pivot configured to permit the lumbar support to pivot with pressure applied by the occupant such that the lumbar support self-adjusts to the occupant;

a lumbar frame connected to the lumbar support and the pivot such that pressure applied by the occupant causes the frame to rotate the lumbar support about the pivot;

an actuator to move the lumbar support along the lumbar frame; and wherein both ends of the frame extend outboard of the lumbar support to facilitate rotation of the lumbar support.

2. The system of claim 1 wherein the lumbar support is connected to the lumbar frame and the lumbar frame is connected to the pivot.

3. The system of claim 1 wherein the pivot is free-floating.

4. The system of claim 1 wherein the lumbar frame is elongated and the actuator moves the lumbar support along a longitudinal axis of the lumbar frame.

5. The system of claim 1 wherein the actuator pivots with rotation of the lumbar frame.

6. The system of claim 5 further comprising a seatback frame, wherein the pivot is connected to the seatback frame such that the actuator, lumbar frame, and lumbar support each simultaneously rotate about the pivot while the seatback frame remains fixed when the pressure is applied by the occupant.

7. The system of 1 wherein the actuator moves the lumbar support in an up/down manner along the lumbar frame.

8. The system of claim 1 wherein the lumbar support flexes in/out with up/down movement of the lumbar support along the lumbar frame.

9. The system of claim 1 wherein at least one end of the frame extends outboard of the lumbar support to facilitate rotation of the lumbar support relative to the pivot when the pressure is applied by the occupant.

10. The system of claim 1 wherein the pivot is connected to a center of the lumbar frame.

11. A seatback system having self-adjusting lumbar, the system comprising:

a lumbar frame having at least two rails;

a lumbar support configured to slide along the two rails of the lumbar frame, wherein one end of the support is controllable to be moved relative to another end of the support in order to flex the support in/out, the flex in/out controlling bulging of the lumbar support; and a pivot connected to the lumbar frame to permit the lumbar support to pivot with pressure applied by an occupant such that the lumbar support self-adjusts to the occupant.

12. The system of claim 11 further comprising an actuator configured to cause up/down movement of the lumbar support relative to the frame by controlling tensioning of cables connected to the ends of the lumbar support.

13. The system of claim 11 further comprising a first actuator having a first cable connected to one end of the lumbar support and a second actuator having a second cable connected to another end of the lumbar support, the actuators configured to move the lumbar support relative to the lumbar frame.

14. The system of claim 13 wherein the actuators are mounted on the lumbar frame and pivot with rotation of the lumbar frame.

15. The system of claim 11 further comprising an actuator configured to cause up/down movement of the lumbar support relative to the frame.

16. The system of claim 15 wherein the actuator is connected to the lumbar frame such that the actuator rotates with the lumbar support and frame when pressure is applied by the occupant.

17. The system of claim 11 wherein the in/out movement results from an actuator causing at least one end of the lumbar support to slide along the two rails such that the in/out flexing of the support is controlled by tensioning of cables connected to the ends of the lumbar support.

18. A method of controlling a lumbar support, the method comprising:

receiving signals for adjusting a positioning of the lumbar support;

controlling an electrically driven actuator to position the lumbar support as a function of the received signals; and rotating the lumbar support about a pivot after the lumbar support is adjusted and as a function of pressure applied thereto by an occupant.

19. The method of claim 18 wherein rotating the lumbar support includes controlling another electrically driven actuator to rotate a pivot connected to the lumbar support.

20. The method of claim 19 further comprising rotating the lumbar support as a function of signals received from pressure sensors attached to outboard ends of a lumbar frame connected to the lumbar support, the outboard ends extending outboard of the lumber support.

* * * * *